United States Patent [19]

Antonevich

[11] 4,423,462

[45] Dec. 27, 1983

[54] CONTROLLED EMISSION STATIC BAR

[75] Inventor: John N. Antonevich, Lansdale, Pa.

[73] Assignee: The Simco Company, Inc., Hatfield, Pa.

[21] Appl. No.: 400,301

[22] Filed: Jul. 21, 1982

[51] Int. Cl.[3] ..... H01T 19/00

[52] U.S. Cl. ..... 361/235; 361/230; 250/324

[58] Field of Search ..... 361/212, 213, 215, 230, 361/231, 235; 250/324, 325, 326; 323/218, 219

[56] References Cited

U.S. PATENT DOCUMENTS 3,714,531 1/1973 Takahashi ..... 361/230

FOREIGN PATENT DOCUMENTS 2724118 3/1978 Fed. Rep. of Germany ..... 361/230

54-152889 12/1979 Japan ..... 250/325

*Primary Examiner*—Reinhard J. Eisenzopf

*Attorney, Agent, or Firm*—Stanley Bilker

[57] ABSTRACT

A controlled emission static eliminator system (wherein an A.C. high voltage is applied to the discharge electrodes of a static bar by way of a transformer) employs a biasing circuit in series with the primary of the transformer to control the amplitude and/or duration of the alternating potentials imposed on the corona discharge points. The biasing circuit includes a series-connected diode and variable resistance in one leg of a parallel network and a capacitor in the other leg. Selecting appropriate time constants for the resistance and capacitance will narrow the first half of the sine wave and broaden the second half to produce an excess of positive or negative ions, as desired, depending upon the direction of the diode. The ion emission can be controlled to yield an equal number of positive and negative ions or a predominance of ions of one polarity and can be accomplished regardless of whether the A.C. high voltage is directly connected or capacitively coupled to the points.

11 Claims, 4 Drawing Figures

CONTROLLED EMISSION STATIC BAR

BACKGROUND OF THE INVENTION

1. Field of the Invention

This invention relates to static eliminators or neutralizers and more particularly relates to corona discharge devices in which an A.C. power supply has its high voltage side connected to the discharge electrodes, usually of pointed disposition, and the other side connected to a conductive member or casing adjacent to the discharge electrodes so that both positive and negative ions are emitted. These dual polarity ions are utilized to neutralize the surfaces of articles electrostatically charged by frictional, mechanical, electrical or other generated forces. The present invention is especially concerned with static eliminator systems in which ion emission can be adjustably controlled to produce an equal number of positive and negative ions or a predominance of ions of a particular polarity.

2. Prior Art

Static eliminators are devices for producing both positive and negative ions in order to neutralize articles or materials which are charged to a particular polarity or which have some of both the positive and negative charges on various portions of their surfaces with a net residual charge in certain zones. When an A.C. high voltage of fairly high magnitude, for example 15,000 volts, is applied across the discharge points and the grounded casing or shield of such static eliminators, positive and negative ions are emitted from the discharge electrodes. While positive and negative ion production may be precisely equal under certain circumstances, in most instances one or the other polarity of ions will predominate depending upon (1) the manner in which the high voltage is connected to the ionizing points, i.e. whether the points are resistively coupled as in a directly connected bar or capacitively coupled as in a "shockless" bar, (2) the geometry of the static bar, in particular the configuration of the grounded portions of the bar and the relationship thereof with respect to the ionizing points and (3) the distance between the static bar and the material to be discharged, as well as the presence of adjacent grounds with respect to the bar, the latter affecting the amounts of the respective positive or negative ions being emitted actually reaching the charged material.

In the direct connected static bar, there is usually a predominance of negative ions produced, even though the discharge points are connected to an A.C. source whose positive and negative voltage is of equal amplitude. The excess negative ion production is as a result of the greater mobility of such negative ions and also because of the inherent characteristics of corona formation wherein ionization occurs over a greater portion of the negative half cycle of voltage in relation to the ionization occurring during the comparable positive half cycle.

In the case of the capacitively coupled static bar, there is usually a predominance of positive ions emitted, the greater positive ion production resulting from the fact that a D.C. voltage is developed across the capacitance in the direction which biases the points slightly positively. That is, in a capacitively coupled system, the characteristic of a point to produce more negative ions during the negative half cycle of imposed voltage causes the capacitance to charge to a positive D.C. voltage which adds algebraically to the A.C. voltage. Hence, the voltage on a point with respect to the casing is greater during the positive half cycle than during the negative half cycle, thereby causing excess positive ions to be emitted in a capacitively coupled bar.

Accordingly, if the material to be discharged lies upon or is adjacent to a grounded (or other) surface, the material may charge up to the polarity of the predominantly positive charge produced by the capacitively coupled bar or to the predominantly negative charges emitted by the direct coupled bar. Where a neutral article or sheet is required, of course it is desirable to have an equal number of positive and negative ions. However, under other circumstances, it is frequently important to charge a sheet just a slight amount either positively or negatively, as when a subsequent sheet sliding upon a pile would frictionally charge the sheet below even though both were neutral prior to stacking. Here, one would wish to cause emission in which ions of one or the other polarity would slighty predominate such that a sheet flowing onto a stack would be previously charged oppositely and to the extent necessary just to neutralize the charge which that sheet would produce in sliding frictionally upon the sheet below.

In U.S. Pat. No. 4,093,543, there is shown a balanced emission system for capacitively coupled (shockless) static eliminators wherein pointed conductive needles connected to the ground side of the A.C. high voltage source are adjacently spaced from and are in interacting disposition with at least some of the pointed discharge electrodes. The points of the "balancing" or control needles are adapted to be adjustably positioned with respect to the discharge electrodes so that an equal number of ions of each polarity are emitted. This provides in effect a mechanical balancing system.

Another method for balancing the number of positive and negative ions emitted was to provide two static bars or two electrodes in a single housing and supplying one bar or electrode with a D.C. voltage of one polarity and the other with a D.C. voltage of the opposite polarity. By controlling the voltage on the respective electrodes, the precise mixture of ions could be generated. However, a D.C. system precludes the use of a capacitive coupling and therefore obviates a shockless static bar construction In U.S. Pat. No. 2,879,395, equalization of ion production for each polarity was accomplished by incorporation a small D.C. power supply either between the casing and ground or between the A.C. generator and ground. This miniature D.C. power supply functioned by placing a D.C. bias of the appropriate polarity on the casing or on the discharge points and was connected in such a way as to retard the output of ions of the opposite polarity. Adjustment of the magnitude of the auxiliary D.C. voltage provided the desired balance of positive and negative ion emission. However, the use of an auxiliary D.C. generator has the disadvantage of requiring a separate power supply, thus making the arrangement expensive and bulky. Furthermore, use of a D.C. power supply in a capacitively coupled static bar requires that it be incorporated in the casing circuit thus causing the latter to be "hot" and necessitating insulation.

In U.S. Pat. No. 3,714,531, the device for controlling the ratio of positive and negative ions is for a direct coupled system only. The controlling circuitry is incorporated in the secondary of the high voltage transformer in one of two ways, (1) by decreasing the negative component of the voltage through the use of a diode in series with the high voltage coil or (2) by increasing the positive component of the A.C. voltage applied to the points through the use of a pair of secondary coils, one being connected directly to the points while the other secondary coil includes a diode and a capacitor in series therewith so as to add to the positive voltage of the first coil. The D.C. on the core of the variable secondary coil changes the permeability of the core and distorts voltage on the other secondary.

It is therefore an object of this invention to provide a static eliminator system in which ion emission can be regulated to produce equal quantities of positive and negative ions or in the alternative a predominance of ions of one polarity.

Another object of this invention is to provide a controlled emission static eliminator in which ion emission can easily be regulated regardless of whether the discharging points are directly or capacitively coupled to the A.C. high voltage source.

Yet another object of this invention is to provide an R-C electrical biasing circuit for the primary of a high voltage transformer in order to minimize size and insulation requirements of the components in a controlled emission static eliminator system.

Other objects of this invention are to provide an improved device of the character described that is easily and economically produced, sturdy in construction and both highly efficient and effective in operation.

SUMMARY OF THE INVENTION

In accordance with the present invention, there is provided a controlled emission static eliminator which employs an R-C biasing circuit in series with the primary of the high voltage transformer to control the amplitude and/or duration of the alternating potentials applied to the corona discharge points. The biasing circuit includes a diode and variable resistor in series with each other and in parallel with a capacitor which discharges across the primary in a particular direction depending upon the diode orientation. By selecting appropriate values for the resistance and capacitance and matching the time constants thereof with respect to the reflected impedance of the load, one can vary amplitude of the transformer voltage as well as manipulating the time periods of each half cycle of imposed voltage. Depending upon the direction of the diode, ion emission can be controlled to yield an equal number of positive and negative ions or a predominance of ions of a particular polarity regardless of whether the A.C. high voltage is connected directly or coupled capacitively to the discharge points.

BRIEF DESCRIPTION OF THE DRAWNGS

With the above and related objects in view, this invention consists of the details of construction and combination of parts as will be more fully understood from the following detailed description when read in conjunction with the accompanying drawing in which:

FIG. 1 is a schematic view of a controlled emission static eliminator system embodying the biasing circuit of this invention for a capacitively coupled static bar.

FIG . 1A is a schematic representation of a direct connected static bar for use with the biasing circuit of this invention.

DESCRIPTION OF PREFERRED EMBODIMENTS

Figure 1:
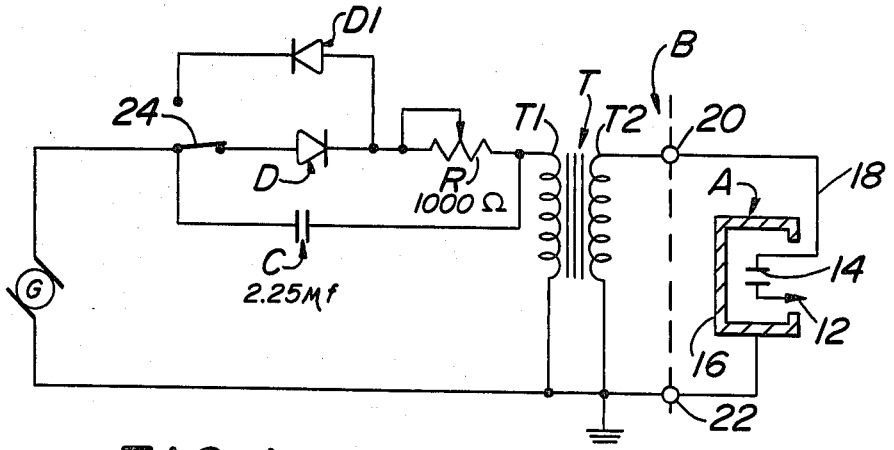

Referring now in greater detail to the drawings in which similar reference characters refer to similar parts, there is shown a controlled emission biasing circuit for modifying the amplitude and/or duration of the alternating potential which is applied to a static eliminator, generally designated as A.

In FIG. 1, the static eliminator A includes discharge points 12 which are capacitively coupled by way of capacitance 14 to an A.C. high voltage power source B and a casing or housing 16 which is connected to ground and adjacently spaced from the points 12. The capacitively coupled static eliminator A is a conventional "shockless" type bar, such as is shown in prior U.S. Pat. No. 3,120,626, U.S. Pat. No. 3,443,155 or U.S. Pat. No. 3,585,448 wherein the discharge points project from conductive rings or a semiconductive sleeve concentrically disposed about an insulative cable 18 whose central conductor is connected to the high voltage side of the power supply B. Terminals 20–22 across the secondary T2 of transformer T are respectively connected to the capacitively coupled points 12 and to the casing 16. As indicated hereinbefore, the capacitively coupled static bar A would ordinarily produce a slight excess of positive ions emanating from its points.

The biasing circuit of the present invention includes a capacitor C which is in series with the primary T1 of the transformer. In parallel with the capacitor C is a series connected diode D and variable resistor R. A switch 24 enables a diode D1 to be incorporated when it is desired to reverse the biasing polarity. The capacitor C is of conventional low voltage 2.25 microfarad design for example, which in combination with the resistance of variable resistor R, a 1000 ohm potentiometer, is adapted to match the impedance of the transformer T. That is for static eliminators, C is selected to provide a capacitance in near resonance with the inductance of the transformer T and its load whereby the peak amplitudes of the voltage at generator G and the primary T1 will be substantially equal. The diode D is preferably a 1 ampere 1N4004 silicon rectifier.

Figure 2:
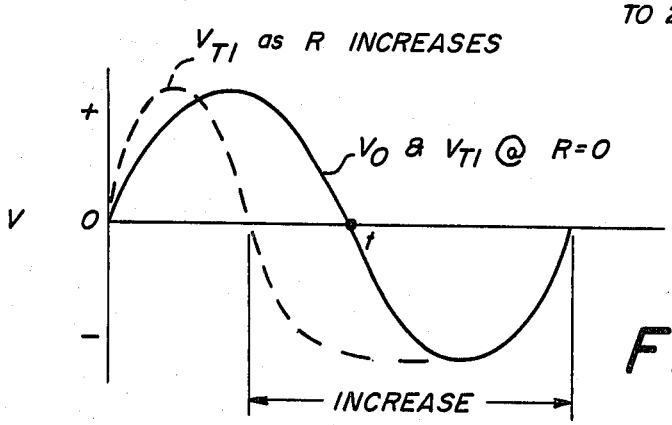
FIG. 2 is a graphic representation of the voltage amplitude versus time curve for generating a predominance of negative ions through the use of the foregoing biasing circuit.

Referring to FIG. 2, the solid line sine wave shown therein represents the line voltage $V_o$ from the generator G (for example, a 110 volt line supply) which would be followed identically by the primary voltage $V_{T1}$ at the transformer T were the biasing circuit not included. With the resistance R equal to zero (i.e. unbiased), the primary voltage $V_{T1}$ would also follow the input voltage $V_o$ since the biasing circuit would be effectively eliminated, except for the diode D. However, as R increases, the positive portion of the cycle is caused to peak slightly and narrow while the time period of the negative portion of the curve is extended. See the dotted curve in FIG. 2 wherein the time period of the negative half cycle has been broadened so that the area under the curve of the negative portion is greater than the positive portion. Thus, with the capacitance of C in near resonance with the inductance of the transformer T and its load, the voltage amplitude at peak voltage would be substantially the same at the transformer primary T1 as at the source G. However, the negative voltage at the primary T1 and hence the high voltage to the points 12 would be of longer duration than the positive portion thereby providing a longer period of negative ion production in the case of the capacitively coupled static eliminator A.

Figure 1A:
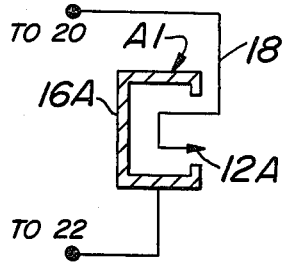

In FIG. 1A, there is shown a direct connected static bar A1 in which discharge electrodes 12A are connected immediately by way of terminals 20–22 to the secondary T2 of transformer T(i.e. no capacitance). Examples of direct connected static bars are shown and described in U.S. Pat. No. 2,163,294 or U.S. Pat. No. 3,137,806 wherein the points 12A are connected directly to the high voltage side of the power supply and the housing 16A is connected to the grounded side of said power supply. The direct connected static bars A1 ordinarily emit a slight excess of negative ions.

Figure 3:
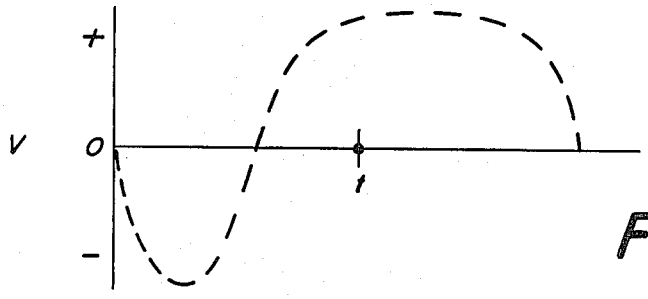
FIG. 3 is a graphic representation of the voltage amplitude versus time curve for generating a preponderance of positive ions by use of the foregoing biasing circuit.

Accordingly, a diode is employed which reverses the direction of the voltages imposed on transformer T. The stitch 24 of the power supply B is thrown to include diode D1 in series with potentiometer R while capacitor C is in parallel therewith. Referring to FIG. 3, the first portion of the sine wave (negative half cycle) is narrowed while the second half or positive portion is extended. Hence, the time period of the positive cycle is of longer duration so that the area under the curve of the positive portion is greater than the negative portion. The provision of a longer period of positive voltage applied to the direct connected points 12A of static bar A1 compensates for the expected predominance of negative ions whereby a balanced ion emission is achieved. Note also that the primary windings T1 or the secondary windings T2 can also be reversed in lieu of switch 24 so that the duration of the positive voltage can be broadened.

With an appropriate choice of (R) and (C) to match the reflected impedance of the load, transformer peak voltages can be maintained constant over the range of adjustment of R, the duration of the second portion of the A.C curve determining the extent of the particular polarity of ion emission. It is also possible to vary the capacitance of C with respect to the inductance of the primary coil T1 to vary voltage amplitude, thus changing total ion count to a higher or lower value. Therefore, it is readily apparent that the biasing circuit of the instant invention can provide a balanced and equal positive and negative ion emission from static eliminators or even a preponderance of ions of one polarity.

Although this invention has been described in considerable detail, such description is intended as being illustrative rather than limiting since the invention can be variously embodied without departing from the spirit thereof, and the scope of the invention is to be determined as claimed.

What is claimed is:

1. A high voltage A.C. power supply for balancing the ion emission of static eliminators coupled to the secondary of a transformer: comprising a biasing circuit connected to the primary of the transformer for directing a D.C. component of current through the core of said transformer sufficient to distort the A.C. wave form, said biasing circuit including impedance means for shortening the duration of the first portion of an A.C. high voltage cycle while increasing the duration of the second portion thereof whereby emission from said static eliminators can be adjusted to provide an equal number of positive and negative ions or a predominance of ions of a particular polarity.

2. The power supply of claim 1 wherein said impedance means comprises a capacitor in series with the primary of the transformer and a series-connected resistor and rectifier in parallel with said capacitor.

3. The power supply of claim 2 wherein said rectifier comprises a diode.

4. The power supply of claim 2 wherein said resistor comprises a potentiometer for varying the resistance thereof.

5. The power supply of claim 2 wherein said rectifier includes a first diode in a first circuit branch for directing current in a predetermined direction through the primary of the transformer, a second diode in a second circuit branch for directing current in a second direction through the primary of the transformer, and switching means to selectively activate the diodes in the respective branches.

6. In a high voltage A.C. power supply having a transformer whose secondary is coupled to the discharge electrodes of a static eliminator, biasing means in series with the primary of said transformer for providing a D.C. component of current through the core of said transformer sufficient to effect distortion of the A.C. wave form, said biasing means so modifying the A.C. duty cycle as to shorten the duration of the first half cycle of A.C. voltage while lengthening the duration of the second portion thereof whereby emission from static eliminators can be balanced to yield an equal number of ions of each polarity or a predominance of ions of a particular polarity.

7. The power supply of claim 6 including means for adjusting said biasing means.

8. The power supply of claim 6 wherein said biasing means comprises a capacitor in series with the primary of said transformer and a series-connected resistor and rectifier means in parallel with said capacitor.

9. The power supply of claim 8 wherein said rectifier means comprises at least one diode.

10. The power supply of claim 8 wherein said resistor is adjustable to permit varying the time constants of said biasing means.

11. The power supply of claim 8 wherein said rectifier means comprises a first diode in a first circuit branch for directing current in a predetermined direction through the primary of the transformer, a second diode in a second circuit branch for directing current in a second direction through the primary of the transformer, and switching means to selectively activate the diodes in the respective branches.

* * * * *